United States Patent [19]

Coombes, Jr. et al.

[11] Patent Number: 4,714,535

[45] Date of Patent: Dec. 22, 1987

[54] MOLDED FRAMEWORK FOR ELECTROLESS AND ELECTROLYTIC PLATING RACKS

[75] Inventors: Robert L. Coombes, Jr., La Canada Flintridge; Merrill J. Owen, La Canada; Terance C. Colwell, West Covina; Donald E. Walker, Upland, all of Calif.

[73] Assignee: Crown City Plating Co., El Monte, Calif.

[21] Appl. No.: 865,758

[22] Filed: May 22, 1986

[51] Int. Cl.[4] ..... B05C 11/00; B05C 11/16; C25D 17/08; A47F 5/08

[52] U.S. Cl. ..... 204/297 W; 204/20; 204/297 R

[58] Field of Search ..... 204/297 W, 297 R, 20

[56] References Cited

U.S. PATENT DOCUMENTS

| | | | |
|---|---|---|---|
| 2,916,431 | 12/1959 | O'Connor | 204/297 |
| 3,035,999 | 5/1962 | Sharon et al. | 204/297 W |
| 3,069,345 | 12/1962 | Lowdermilk et al. | 204/297 R |
| 3,429,786 | 2/1969 | Kubik | 204/15 |
| 3,497,446 | 2/1970 | Clapper et al. | 204/297 D |
| 3,563,878 | 7/1968 | Grother | 204/297 R |
| 3,923,631 | 12/1975 | Palisin, Jr. | 204/297 |
| 3,939,056 | 2/1976 | Fueki et al. | 204/297 R |
| 3,970,540 | 7/1976 | McBain | 204/297 W |
| 3,972,785 | 8/1976 | Palisin | 204/297 R |
| 3,972,798 | 8/1976 | Palisin | 204/297 R |
| 4,014,778 | 3/1977 | Harrison | 204/297 W |
| 4,037,727 | 7/1977 | Kunkle | 211/117 |
| 4,097,359 | 6/1978 | Davitz | 204/297 R |
| 4,148,707 | 4/1979 | Mayer et al. | 204/297 W |
| 4,224,123 | 9/1980 | McLain | 204/297 R |
| 4,540,478 | 9/1985 | Mallok et al. | 204/297 W |

*Primary Examiner*—Arthur P. Demers

*Attorney, Agent, or Firm*—Christie, Parker & Hale

[57] ABSTRACT

A platable plastic product substrate assembly is disclosed. The product substrate assembly comprises a runner system having at least one runner and at least one clip for engaging the framework of a plating rack. A plurality of product substrates are removably attached to gates with clip protruding from the runner.

28 Claims, 26 Drawing Figures

MOLDED FRAMEWORK FOR ELECTROLESS AND ELECTROLYTIC PLATING RACKS

FIELD OF THE INVENTION

This invention relates to the art of plating on plastics and, more particularly, to an injected molded assembly having a runner system on which product substrates are attached which includes clip means for attaching the runner system to the framework of electroless and electrolytic plating racks.

BACKGROUND OF THE INVENTION

In recent years, many plated products comprise a molded plastic substrate which is first electrolessly plated and then electrolytically plated.

In conventional electroless plating processes, the plating substrate is first etched with a strong oxidizing acid or base. The etched substrate is then immersed in a solution containing a noble metal catalyst, e.g., a tin-palladium catalyst. If required, the substrate is then immersed in an activator solution, e.g., exposing the palladium of the tin-palladium catalyst. Finally, the activated substrate is immersed in an autocatalytic electroless plating solution where an initial coating of a conductive metal, such as copper or nickel, is established on the substrate by chemical deposition.

In a conventional electrolytic plating process, the electrolessly plated plastic substrate is first immersed in cleaning solutions and then activated by immersion in a dilute acid solution, e.g., a dilute sulfuric acid solution. It is then immersed in one or more electroplating baths wherein metal is deposited on the surface of the substrate electrolytically. In many applications, for example, layers of copper, nickel, and chromium are plated onto the substrate.

Conventional plating racks used in electroless and electrolytic plating processes comprise a metal framework having metal contacts for holding the plastic substrates on the rack. With electrolytic plating racks, the contacts also provide means for electrical communication between the racks and the plastic substrates. The plastic substrates are manually mounted on the contacts which hold the substrates firmly so that they do not fall off the racks in agitated plating solutions and, in the case of electrolytic plating racks, to provide uninterrupted electrical contact with the substrates.

The contacts are typically in the form of metal wire, rods, strips, and the like. Two or more contacts are usually used in a manner which applies pressure, generally in the form of a spring force or a gripping force, at two or more contact points on the substrate. These contact points are generally at locations on the substrate which are not seen when the substrate is assembled as a final product.

The number of substrates held by an electroless or electrolytic plating rack depends on the size of the rack, which is in turn usually dependent on the size of the plating tanks, and on the size of the substrates. It is not uncommon for an electroless or electrolytic plating rack to hold 25 or even 100 or more substrates. Since each substrate typically requires at least two rack contacts, it is apparent that such racks require a great deal of material and time to construct and are accordingly very expensive to build. Moreover, many substrates are difficult to hold and require complicated contact design. This further increases the expense of constructing the racks.

For very small substrates or for substrates which, because of their design, cannot be held directly by the rack contacts, the plating racks are designed so that the contacts grip or otherwise hold a runner or portion of a runner which is not removed from the substrate after it is molded. Here again, however, the rack must comprise separate contacts for each such runner. Such racks are expensive and time consuming to construct for the reasons mentioned above.

Not only are conventional plating racks expensive to build, their utility is restricted to the particular substrate or substrates for which it is designed. Once the production of that particular substrate is over, the use of that plating rack ceases and it must be discarded or rebuilt to hold a different substrate.

SUMMARY OF THE INVENTION

The present invention provides a molded product substrate assembly which eliminates the need for separate plating rack contacts for each product substrate. The product substrate assembly comprises a runner system to which at least one product substrate is removably attached. The runner system comprises at least one runner and means for releasably engaging the framework of a plating rack, i.e., electroless and/or electrolytic plating rack.

Preferred means for releasably engaging the framework of an electrolytic plating rack comprises one of more clips along one runner for gripping the plating rack framework. A preferred means for releasably engaging the framework of an electroless plating rack comprises a second clip for releasably gripping, the electroless plating rack framework. Another preferred means for releasably engaging the framework of an electroless plating rack comprises one or more capturing members which either captures or is captured by the framework of the electroless plating rack to thereby hold the substrate assembly within the electroless plating rack framework.

In a preferred embodiment of the invention, the runner system further comprises means for releasably engaging the framework of an electroless plating rack and means for releasably engaging the framework from an electrolytic plating rack.

In another preferred embodiment of the invention, the runner system comprises spacers for spacing the product substrate of assembly from an adjacent product substrate assembly mounted on the framework of an electrolytic and/or electroless plating rack. Preferred spacers comprise coupling means for engaging adjacent product assemblies so that one product assembly can be stacked on top of an adjacent product assembly.

BRIEF DESCRIPTION OF THE DRAWINGS

These and other features and advantages of the present invention will be better understood by reference to the following detailed description when considered in conjunction with the accompanying drawings wherein.

DETAILED DESCRIPTION

Figure 1:
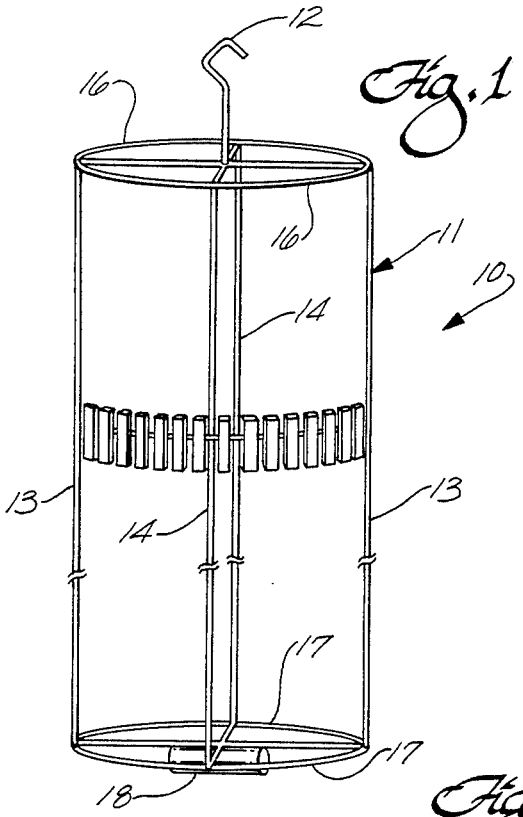
FIG. 1 is a perspective view of a product substrate assembly mounted on an electroplating rack.

In the preferred practice of the present invention, there is provided a one-piece injection molded plastic product substrate assembly which can be mounted on the framework of an electrolytic plating rack and on the framework of an electroless plating rack. An electrolytic plating rack particularly suited for use with the product substrate assembly of the present invention has only a metal framework, i.e., having no contacts for holding product substrates. With reference to FIG. 1, such a plating rack 10 comprises a framework 11 which is immorsed in various solutions during the course of an electroplating process. The framework 11 is suspended from a hook 12.

The hook 12 may be of any appropriate design for engaging the cathodic connection of the electroplating tank, whether that be a simple bugg bar or the arm or an automatic electroplating machine. The framework 11 is made of metal, preferably stainless steel, and comprises a pair of generally vertical side rails 13 and a pair of spaced apart center rails 14. The center rails 14 are spaced apart forwardly and rearwardly from the plane of the side rails 13 and are connected to the side rails 13 at their top ends by upper framing members 16 and at their bottom ends by lower framing members 17. The upper and lower framing members 16 and 17 are covered with a non-conductive coating, e.g., plastisol, to prevent plating on those members. The metal of the side rails 13 and center rails 14 are exposed to enable electrical contact with the product substrate assemblies.

The electroplating rack 10 further comprises a weight 18, e.g., a lead block, or the like at its lower end to prevent [unwanted vertical movement, i.e.], bouncing or jostling of the electroplating rack 10 when immersed in agitated solutions. The weight 10 assures undisrupted contact between the hook 12 and the cathode connection, e.g., buss bar of the electroplating tank. The weight 18 is covered with a non-conductive coating to prevent plating on it.

Figure 2:
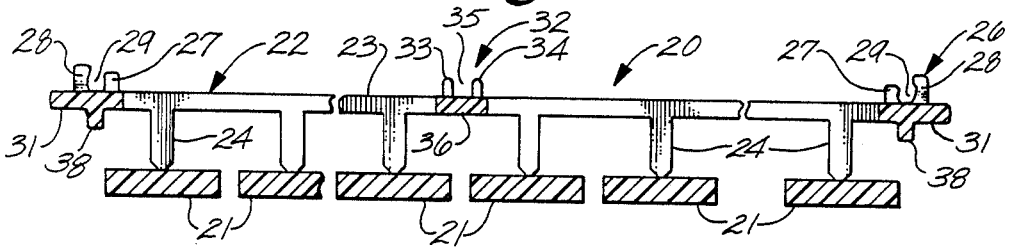
FIG. 2 is a top cross-sectioned view of the product substrate assembly.
Figure 3:
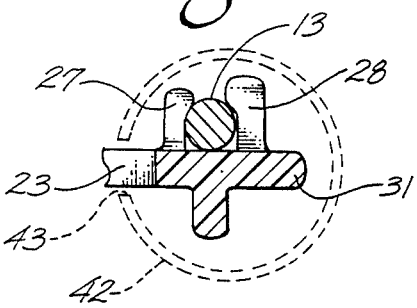
FIG. 3 is an enlarged top cross-sectioned view of the end of the runner of the product substrate assembly of FIG. 2 shown attached to the framework of an electroplating rack and also showing in phantom the framework of the electroless plating rack of FIG. 5.
Figure 4:
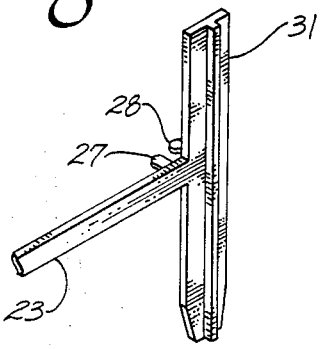
FIG. 4 is a fragmentary perspective view of the end of the runner of the product substrate assembly of FIG. 2 showing an end spacer.

With reference to FIGS. 2–4, there is shown a product substrate assembly constructed in accordance with the present invention for use with the plating rack of FIG. 1. The product substrate assembly 20 is a one-piece injection molded unit made of a pliable plastic such as ABS, nylon and the like. The product substrate assembly 20 comprises a plurality of product substrates 21 which, in the embodiment shown, are rectangular plates, e.g., name plates. The product substrates 21 are attached to a runner system 22 which, in the embodiment shown, comprises a single elongated, generally horizontal main runner 23 and a plurality of gates 24 which extend forwardly from the main runner 23 to the product substrates 21.

The gates 24 are of conventional design used in injection molding product substrates. However, rather than detaching the product substrate from the gates immediately after molding, the product substrates remain attached. The gates 24 maintain the product substrates 21 in proper orientation and spacing during electroless plating and electroplating.

After electroplating, the product substrates 21 can be degated if removed from the runner system 22 by conventional means such as twisting the product substrate 21 until it detaches from the gate 24, clipping the gate with a pin of wire snips, or the like. This typically leaves a blemish or scar on the product substrate at the location of the gate. Accordingly, molds are preferably designed so that the gates 24 are attached to the product substrates 21 at locations which cannot be seen when the product substrate is assembled into a final product.

In the embodiment shown, the gates 24 are attached to the back side of the name plates. The gates 24 narrow adjacent the product substrate to facilitate detachment of the product substrate and to minimize the size of the blemish which remains.

The runner system 22 further comprises a pair of end clips 26 for releasably attaching the product substrate assembly 20 to the side rails 13 of the framework 11 of the electroplating rack 10. The end clips 26 comprise a pair of fingers 27 and 28 which extend rearwardly at each end of the main runner 23. The fingers 27 and 28 are spaced apart forming a slot 29 having a width about equal to the diameter of the side rails 13 of the plating rack framework 11 to which it is attached. Each finger 27 and 28 has an enlarged end remote from the main runner 23, the distance between the enlarged ends being slightly less than the diameter of the side rails 13 of the plating rack framework 11. Thus, the opening to slot 29 is slightly less than the diameter of the side rails 13.

The product substrate assembly 20 is mounted on the electroplating rack by pressing the side rail 13 into the slot 29 so that the enlarged ends of the fingers 27 and 28 capture the side rail 13 and hold it firmly within the slot 29. Such an arrangement not only keeps the product substrate assembly 20 firmly attached to the plating rack 10, but assures continuous electrical contact between the plating rack 10 and the product substrate assembly 20.

In the embodiment shown, the outer finger 28 is slightly longer than the inner finger 27. In such an arrangement, the outer finger 28 acts as a hook which resists disengagement from the side rail 13 when the runner system 22 is pulled laterally toward the center of the electroplating rack, as occurs, for example, during the mounting of the product substrate assembly 20 on the electroplating rack. It is apparent, however, that arrangements in which the fingers are the same size or where the outer finger 28 is shorter than the inner finger 27 may be used if desired.

With reference to FIGS. 3 and 4, at each end of the main runner 23 there is a spacer 31 which extends vertically a select distance above and below the main runner 23 preferably to positions slightly above and below the top and bottom edges of the product substrates 21. The spacer 31 serves as a shield to the side rails 13 of the plating rack framework 11, reducing the amount of metal which is deposited on the side rails 13. This in turn reduces the time and materials required to strip the plating rack between plating runs.

The spacer 31 facilitates mounting of the product substrate assemblies 20 on the electroplating rack 10. By selecting the proper vertical length of the spacer 31, the desired spacing between product substrates of adjacent product substrate assemblies mounted on the electroplating rack can be achieved easily by mounting adjacent product substrate assemblies on the plating rack with the spacer 31 of one product substrate assembly abutting the spacer 31 of the adjacent product substrate assemblies 20. This prevents mounting of adjacent products substrate assemblies too close or too far apart.

If desired, the outer and/or inner fingers 28 and 27 may also extend vertically the full length or any portion of the length of the spacer 31. In such an embodiment, the fingers 27 and/or 28 along with the spacer 31 form a shield which wraps around the side rails 13, further reducing the amount of metal which deposits onto the plating rack framework. It is to be understood, however, that while such a shield is desirable, it is not required for the practice of the invention.

Figure 5:
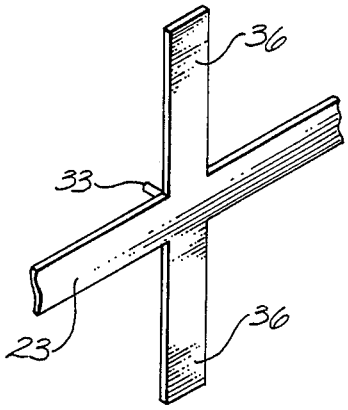
FIG. 5 is a fragmentary perspective view of the center of the runner of the product substrate assembly of FIG. 2 showing a center spacer.

With reference to FIGS. 1 and 5, the runner system 22 comprises a center guide 32 having a pair of fingers 33 and 34 which extend rearwardly from the main runner 23 at about its midpoint. The fingers 33 and 34 are spaced apart a distance about equal to the diameter of the center rail 14 of the electroplating rack framework 11 and form a slot 35 for receiving the center rail.

A center spacer 36 extends above and below the main runner 23 preferably to positions above and below the top and bottom edges of the product substrates 21. Like the spacer 31, the center spacer 36 forms a shield which reduces the amount of metal which plates onto the center rail 14 of the plating racks framework 11.

In the embodiment shown, the center guide 32 does not clip onto the center rail 14 but rather provides a means for properly aligning the product substrate assembly 20 on the electroplating rack 10. It is apparent, however, that if desired, a center clip similar to the end clips 26 could be provided rather than a center guide. It is further apparent that the center clip or guide may be simply omitted. Likewise, the center spacer 36 need not be present. Alternatively, one or both of the fingers 33 and 34 may extend vertically along the center spacer 36 to form a larger shield which wraps around the center rail 14 to further reduce plating on it.

During electroplating the framework of the plating rack and the product substrate assemblies mounted on the framework are immersed in an electroplating bath. Such baths typically have a plurality of anodes aligned in a generally straight line adjacent opposite sides of the plating tank. Because the center rails 14 of the plating rack are spaced apart forwardly and rearwardly from the side rails 13, the product substrates 21 adjacent the side rails 13 of the plating rack 10 tend to be spaced apart farther from the anodes during electroplating than the product substrates 21 adjacent the center rail 14 of the electroplating rack 10. Such an arrangement is preferred as it tends to minimize the difference in current density at the product substrates 11 near the side rails 22 of the electroplating rack and at the product substrates 11 near the center rail 14. Before electroplating, the product substrate assembly 20 is electrolessly plated to establish a thin conductive metal layer over the product substrate assembly 20. This thin metal layer then acts as a buss to enable a thicker metal coating to be built up during the subsequent electroplating process. In the electroless plating process, the surface of the clips 26, runner 23, gates 24, and product substrates 21 must all be electrolessly plated to assure an electrical connection between the electroplating rack and the product substrates during subsequent electroplating. Because the initial thin metal layer is deposited chemically, these surfaces must be free of contact with other objects. This means that the clips 26 which are used to mount the product substrate assembly 20 on the electroplating rack cannot be used in the same manner to mount the product substrate assembly on the electroless plating rack. If they were, the surfaces of the clips 26 in contact with the electroless plating rack framework would not be electrolessly plated with the result that the clips 26 would be unable to make the required electrical contact with electroplating rack during electroplating.

Accordingly, the runner system 22 of the product substrate assembly 10 is designed to be mounted on the framework of an electroless plating rack without utilizing the contact area of the clips 26, i.e., the portions of the clips 26 which engage and contact the framework of the electroplating rack. In the embodiment shown, the product substrate assembly comprises a rib 38 which extends forwardly along the vertical length of the spacer 31. The forwardly extending rib 38, along with the rearwardly extending first and second fingers 27 and 28 form an enlarged end unit for mounting the product substrate assembly 20 on the framework of an electroless plating rack.

Figure 6:
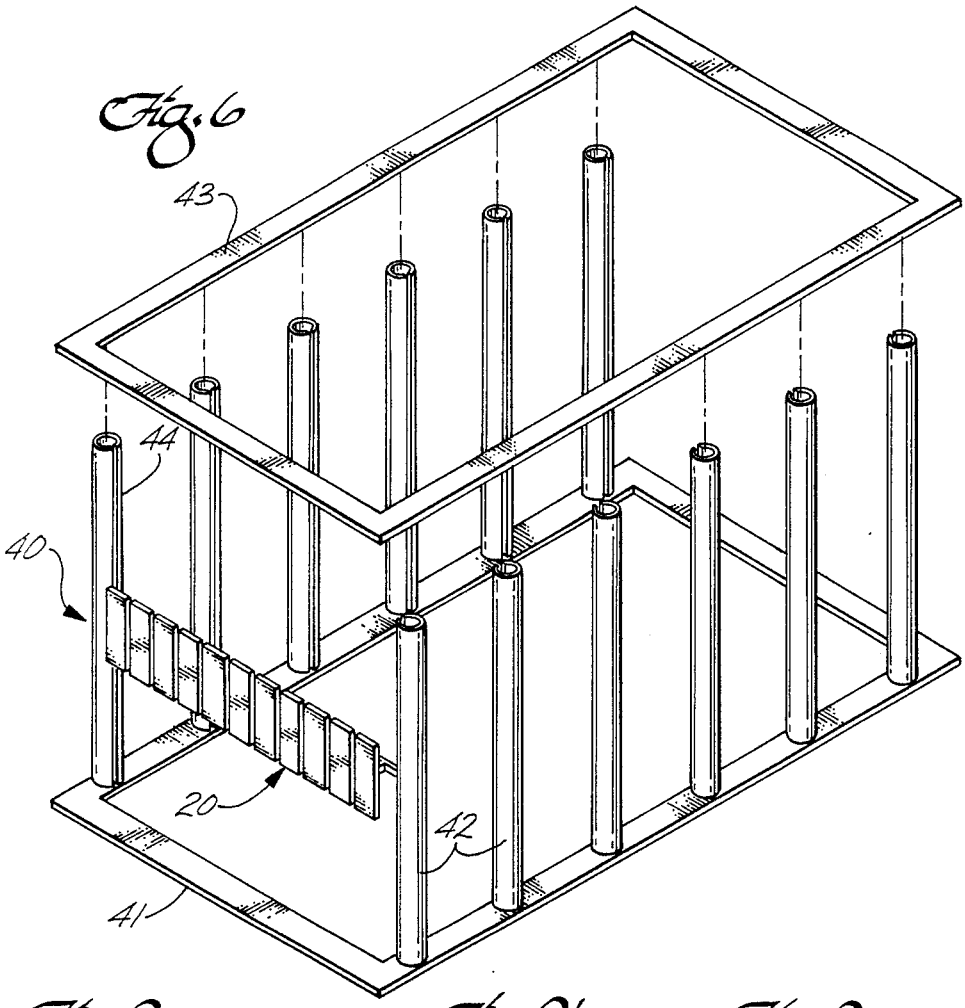
FIG. 6 is a perspective view of a product substrate assembly mounted on the framework of a preferred electroless plating rack.

With reference to FIG. 6, a preferred electroless plating rack comprises a generally rectangular base frame 41 and a plurality of pairs of generally vertical hollow tubes 42, open at their upper ends, extending upwardly from opposite sides of the base frame 41. A removable generally rectangular top frame 43 covers the open ends of the tubes. The tubes 42 of a tube pair are spaced apart a distance about equal to the distance between the end units of the runner system 22. Each tube 42 comprises a generally vertical slot 44 along the length of the tube 42. Each slot 44 is located so that it faces and is generally parallel with the slot 44 of the other tube 42 of the tube pair. The width of the slot 44 is slightly larger than the diameter of the main runner 23.

The ends of the runner system, including the spacers 31, are inserted into the tubes at their upper ends with the main runner extending through the slots as shown in FIG. 3. In such an arrangement, the tubes 42 capture the enlarged end units of the runner system 22 and prevent substantial lateral movement of the product substrate assembly 20.

Vertical movement of the product substrate assembly 20 is restricted by stacking one product substrate assembly 20 on top of another until the tubes 42 are full and then releasably mounting the top frame 43 over the tubes 42. In such an arrangement, the spacer 31 of one product substrate assembly 20 rests on the spacer 31 of the product substrate assembly 20 below it. Because the spacers 31 extend above and below the top and bottom edges of the product substrates 21, the product substrates 21 of one product substrate assembly 20 do not contact those of the adjacent product substrate assemblies 20.

Figure 7:
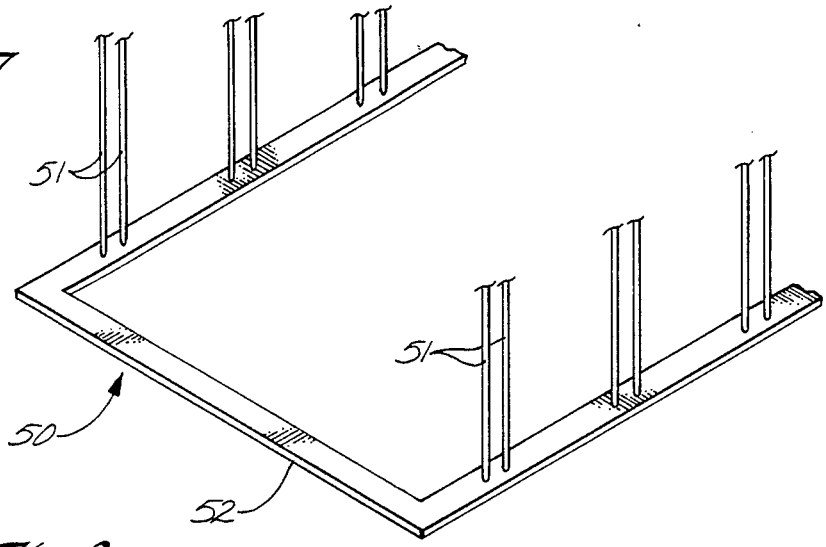
FIG. 7 is a fragmentary perspective view of another preferred electroless plating rack.
Figure 8:
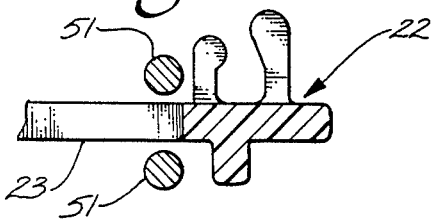
FIG. 8 is a fragmentary top cross-sectioned view of the end of the runner of the product substrate assembly of FIG. 2 and a rod pair of the electroless plating rack of FIG. 7.

It is apparent that, for the particular product substrate assembly 20 described above, electroplating and electroless plating racks having various framework designs may be used. For example, rather than an electroless plating rack comprising a series of spaced apart tubes 42, as described above, the electroless plating rack 50 may simply comprise a series of vertical spaced apart rod pairs extending upwardly from a rectangular base frame 52, as shown in FIGS. 7 and 8. With such an electroless plating rack, each enlarged end unit of the runner system 22 is captured by a pair of rods 51 spaced apart a distance slightly greater than the diameter of the main runner 23 but less than the diameter of the enlarged end unit of the runner system 22. Lateral movement is thus prevented by the rods 51 and vertical movement is prevented by stacking the product substrate assemblies 20 in the same manner as described above. A removable top framing member (not shown) secure the product substrate assemblies 20 within the electroless plating rack framework.

It is equally apparent that the design of the product substrate assembly may vary. For example, in the above described embodiment, the runner system comprised a single generally horizontal main runner. It is apparent that other runner systems comprising for example, a primary runner and secondary runner branching off the primary runner may be used. For large product substrates, such a runner system may be required.

The means for releasably engaging the framework of an electroplating rack in the above embodiment comprised a clip 26 at each end of the main runner 23. It is apparent that the design, number, and location of the clips required in a particular application will vary according to the design of the runner system and the design of the plating rack framework. Moreover, means for releasably engaging the electrolytic plating rack framework other than clips may be used.

With reference to FIG. 9, there is shown a number of engaging means which may be utilized in the practice of this invention. For example, FIGS. 9*a* and 9*b* show variations of the clip shown in FIG. 2. The clip 61 of FIG. 9*a* comprises an outer finger 62 which extends rearwardly and inwardly from the main runner 63 and an inner finger 64 which is simply a bump on the main runner 63. In FIG. 9*b*, the clip 66, the outer finger 67 and inner finger 68 both extend straight back and are the same length. FIG. 9*c* shows a C-shaped clip 69 at the end of a main runner 70 for mounting on the vertical side rails of a plating rack. In this design, the clip 69 extends downwardly to function as a spacer as well as to hold the product substrate on the electroplating rack. FIG. 9*d* shows a clip 71 similar to that shown in FIG. 9*c* for mounting on a horizontal member of a plating rack framework.

Figure 9A:
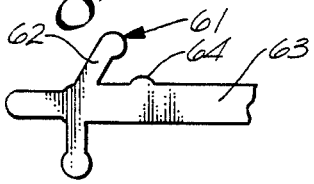
FIGS. 9A to 9F shows various alternative means for engaging the framework of an electrolytic plating rack.
Figure 9B:
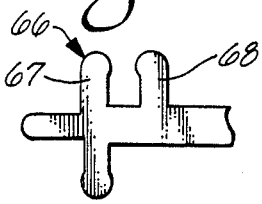
Figure 9C:
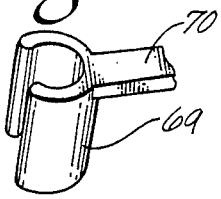
Figure 9D:
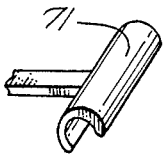
Figure 9E:
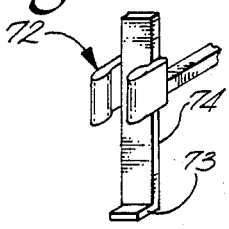

FIG. 9*e* shows a clip 72 having a foot 73 at the lower end of a spacer 74 which spaces the lower end of the spacer away from the side rail or other vertical member of the plating rack framework. Such a clip design may be used, for example, if it is desired to tilt the product substrate.

Figure 9F:
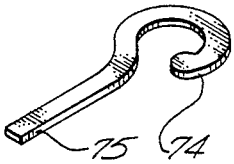

FIG. 9*f* shows a hook 74 at one end of the main runner 75 which may be used in conjunction with a clip at some other location on the runner, e.g., at the other end of the main runner 75.

Figure 10A:
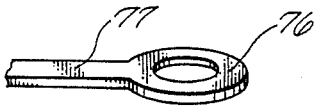
FIGS. 10A to 10E show various alternative means for engaging the framework of an electroless plating rack.
Figure 10B:
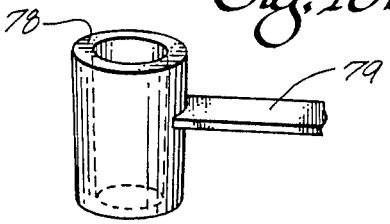
Figure 10C:
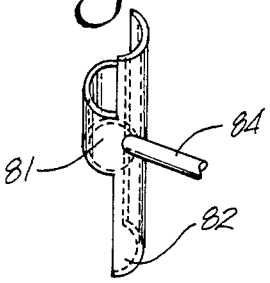
Figure 10D:
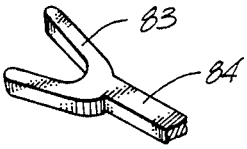

It is equally apparent that the means for releasably engaging the framework of an electroless plating rack may vary. For example, rather than providing a member such as the enlarged end unit of the runner system as described above which is captured by the electroless plating rack framework, the runner system may comprise a member which captures the electroless plating rack framework. FIG. 10 shows various alternative designs which capture the electroless plating rack framework. FIG. 10*a* shows a ring 76 at the end of the main runner 77 which may be mounted in surrounding relation to a vertical rod or bar of an electroless plating rack framework. FIG. 10*b* shows a similar arrangement only using a hollow cylinder 78 at the end of the main runner 79 instead of a ring. The length of the cylinder 78 is preferably chosen so that it acts as a spacer. FIG. 10*c* shows a cylinder 81 with a portion of the cylinder 81 extending upwardly and downwardly thereby forming a spacer 82. FIG. 10*d* shows a simple Y-structure 83 which may be used at each end of the main runner 84 or as a guide.

Figure 10E:
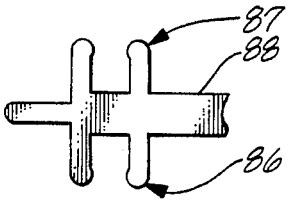

FIG. 10*e* shows a partially preferred arrangement comprising a pair of clips 86 and 87. The first clip 86 is providing for engaging the framework of an electroplating rack as previously described, clip 87 is provided for engaging the framework of an electroless plating rack. As shown, each clip 86 and 87 comprise a pair of fingers which extend forwardly and rearwardly, respectively, from the main runner 88. Arrangements wherein the fingers differ in length may also be used.

Figure 11:
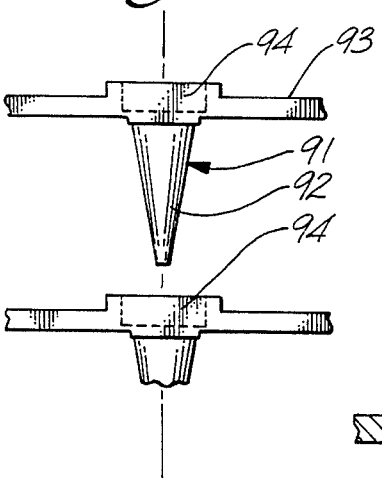
FIG. 11 shows an alternative spacer design.

In the embodiment shown in FIGS. 2–4, the spacer 31 provided a means for maintaining a separation between the product substrates of adjacent product substrate assemblies. It is apparent that spacers of other designs may be used. For example, FIG. 11 shows a spacer 91 comprising of inverted truncated cone 92 which extends downwardly from a main runner 93. At the top of the spacer 91, there is a cylindrical recess 94. In this arrangement, one product substrate assembly may be stacked on top of another with the lower end of the cone portion of the spacer 92 resting on the floor of the cylindrical recess of the product substrate assembly below it.

Figure 12:
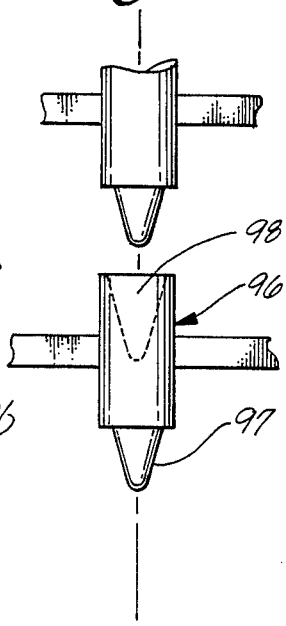
FIG. 12 shows another alternative spacer design.

FIG. 12 shows another preferred spacer 96 which comprises a conical lower end 97 and a conical recess 98 at its upper end. In such an embodiment, one product substrate assembly may be stacked on another with the conical lower end of the spacer 96 inserted into the conical recess 98 in the spacer of the product substrate assembly below it.

Figure 13:
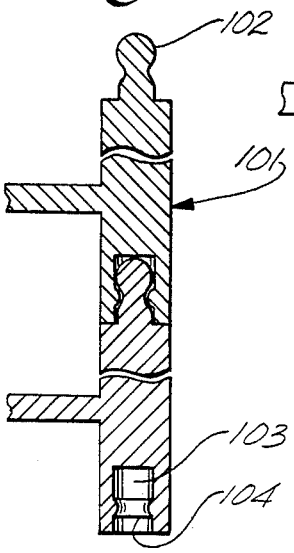
FIG. 13 shows yet another alternative spacer design having a clip arrangement.

FIG. 13 shows yet another spacer arrangement. In this embodiment, the spacer 101 comprise a ball 102 at its upper end and a socket 103 at its lower end for receiving the ball 102 of a similar spacer of a second product substrate assembly below it. The socket 103 comprises a circumvented rib 104 which captures the ball of the second product substrate assembly holding it firmly in place.

In such an embodiment, numerous product substrate assemblies may be clipped together forming a network of product substrate assemblies. Such an arrangement may obviate the need for mounting the product substrate assemblies on electroless and/or electrolytic plating racks. In other words, if desired, such a network may simply be hung from the arm of an electroless or electrolytic plating rack machine. If this is done, it may be necessary to attach a suitable weight to the network to maintain immersion of the network in high density solutions and/or highly agitated solutions.

Figure 15:
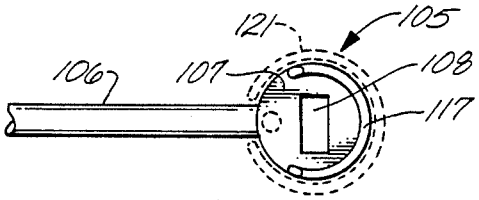
FIG. 15 is a fragmentary top view of the end unit shown in FIG. 14.
Figure 14:
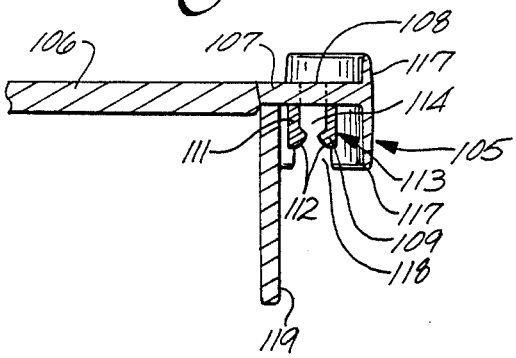
FIG. 14 is a fragmentary side cross section view of an end unit comprising a spacer and a clip at the end of runner.
Figure 16:
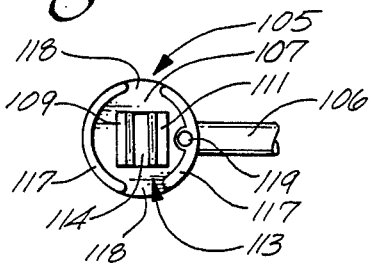
FIG. 16 is a fragmentary bottom view of the end unit shown in FIG. 14.

FIGS. 14–16 show an end unit 105 comprising a spacer and clip at the end of a runner 106 which is particularly useful with an electroless plating rack as shown in FIG. 6. The end unit 105 comprises a generally flat circular plate 107 having a generally rectangular opening 108 in it. Extending downwardly from the plate 107 on each side of the opening 108 are generally rectangular fingers 109 and 111, each having an inwardly protruding tang 112. The fingers 109 and 111 form a clip 113 having a slot 114 into which a rod or bar of the framework of an electroplating rack may be pressed.

The clip 113 is surrounded and protected by a guard 117 which extends about the periphery of the plate 107 above and below the plate 107. Above the plate 107 the guard 117 is generally semi-circular or C-shaped, the opening of the "C" being at the end of the runner 106. Below the plate 107 the guard 117 comprises two curved sections facing each other and spaced apart to form a pair of gaps 118 which are aligned with the slot 114 of the clip 113 so that a rod or bar of the framework of an electroplating rack can be inserted into the slot 114.

Extending downwardly from the plate 107 at a location spaced apart from the clip 113 and adjacent the end of the runner 106 is a spacer bar 119. When stacked on top of another product substrate assembly, the bottom end of the spacer bar 119 sits on the top surface of the plate 107 of the product substrate assembly below it.

The diameter of the plate 107 and hence, the outer diameter of the guard 117 is selected to be only slightly less than the inner diameter of the tubular members 121 of the electroless plating rack as shown in FIG. 15. This restricts movement of the end unit 105 within the tubular members 12, and thereby keeps the spacer bars 11 properly aligned with the end unit 105 of the product substrate assembly below it.

Figure 17:
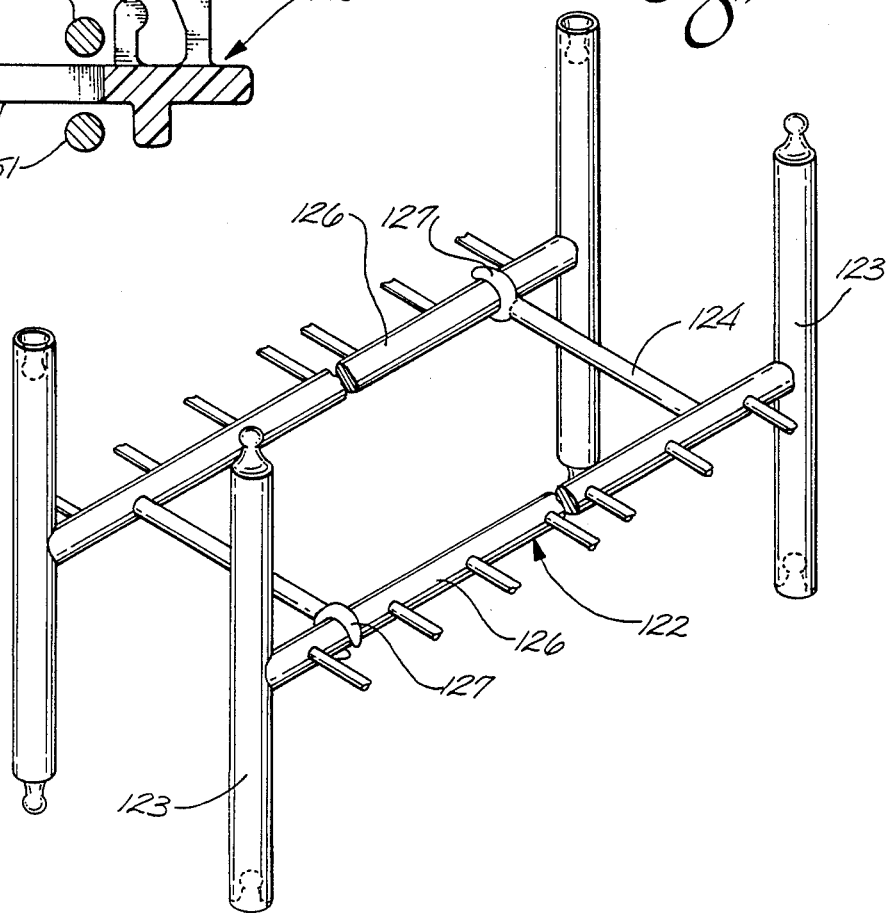
FIG. 17 is a perspective view of a pair of product substrate assemblies with clip together and to other product substrate assemblies.

In FIG. 17, there is shown a particularly preferred embodiment of the invention wherein the runner systems of various product substrate assemblies are clipped together to form a network of product substrate assemblies. In this embodiment, each runner system 122 comprises a pair of vertical spacers 123, for example, as shown in FIG. 13, and a single horizontal spacer 124 adjoined at one end of the main runner 126. The horizontal spacer 124 extends rearwardly from the main runner 126 and comprises a clip 127 at the end remote from the main runner 126. The clip 127 has a pair of spaced apart fingers which form a slot for receiving and gripping the main runner of another product substrate assembly.

In clipping two product substrate assemblies together by means of the horizontal spacer, the orientation of the second product substrate assembly is reversed, as compared to the first, so that the clip 127 of one product substrate assembly engages the main runner 126 of the other product substrate assembly at the end of that runner opposite its horizontal spacer.

Additional product substrate assemblies may be combined by means of the vertical spacers to form a complex network. Such a network may be mounted on the framework of an electroless and/or electrolytic plating rack, for example, by the inclusion of additional clips or the line in the runner system. Alternatively, the network may simply be suspended from the arm of an electroless and/or electrolytic plating machine on the line without the use of a plating rack.

The product substrate assemblies of the present invention provides several unique advantages. For example, by incorporating clips or other means for mounting the product substrate assembly onto electrolytic and electroless plating racks, an operator need never touch the actual product substrates. This reduces the number of parts which must be rejected after electroplating due to defects created by handling.

Further, the present invention eliminates the need for individual contacts on the electroless and/or electrolytic plating racks. This greatly reduces the cost of building the plating racks as well as maintaining, e.g., repairing, those racks. By utilizing the present invention, plating racks may be standardized into a relatively small number of sizes, shapes, or designs.

Depending on the design of the product substrate and runner system, it may be possible to utilize a double shot molding technique wherein a high grade platable plastic is injected into and fills the product substrate cavities and a less expensive lower grade platable plastic is used to fill the runner system, thereby reducing the overall cost of the product substrate assembly.

Another advantage is that shields may be incorporated into the runner system which reduce the mount of plating which occurs directly in the plating rack framework. This reduces the time, effort, and expense in stripping the plating racks between plating runs.

If desired, the runner systems or the product substrate assemblies may be designed to clip together rather than, or in addition to, the plating racks. This may eliminate the need for and associated expense of, building the plating racks in the first place.

The preceding description has been presented with reference to several presently preferred embodiments of the invention which are shown in the accompanying drawings. Workers skilled in the art and technology to which this invention pertains will appreciate that other alterations or changes in the described structures can be practiced without meaningfully departing from the principles, spirit and scope of this invention.

Accordingly, the foregoing description should not be read as pertaining only to the precise structures described, but rather should be read consistent with and as support for the following claims which are to have their fullest fair scope.

What is claimed is:

1. A product substrate assembly mountable on the framework of a plating rack comprising:

a runner system comprising at least one runner and means for releasably engaging the framework of the plating rack; and at least one product substrate removably attached to the runner.

2. A product substrate assembly as claimed in claim 1 wherein the plating rack is an electroplating rack and;

the means for releasably engaging the framework of the electroplating rack comprises at least one clip for releasably gripping the framework of the electroplating rack.

3. A product substrate assembly as claimed in claim 1 wherein the plating rack is an electroless plating rack and;

the means for releasably engaging the framework of the electroless plating rack comprises at least one member which releasably captures the framework of the electroless plating rack.

4. A product substrate assembly as claimed in claim 1 wherein the plating rack is an electroless plating rack and the means for releasably engaging the framework of the electroless plating rack comprises at least one member which is releasably captured by the framework of the electroless plating rack.

5. A product substrate assembly as claimed in claim 1 wherein the runner system comprises first means for releasably engaging the framework of an electroplating rack and second means for releasably engaging the framework of an electroless plating rack.

6. A product substrate assembly as claimed in claim 1 wherein the runner system further comprises at least one spacer for assuring a desired spacing between the product substrate assembly and an adjacent product substrate assembly when the product substrate assembly is mounted on the framework of the plating rack.

7. A product substrate assembly as claimed in claim 6 wherein the spacer comprises means for releasably engaging the runner system of an adjacent product substrate assembly.

8. A product substrate assembly releasably attachable to the framework of an electroplating rack comprising:

a runner system comprising:

at least one runner;

at least one gate protruding from the runner; and clip means for releasably gripping the framework of the electroplating rack; and a product substrate removably attached to each gate.

9. A product substrate assembly as claimed in claim 8 wherein the runner system further comprises at least one spacer for assuring a desired spacing between the product substrate assembly from an adjacent product substrate assembly when the product substrate assembly is attached to the framework of the electroplating rack.

10. A product substrate assembly as claimed in claim 8 wherein the runner system further comprises means for releasably engaging the framework of an electroless plating rack.

11. A product substrate assembly mountable on the framework of an electroless plating rack comprising:

a runner system comprising:

at least one runner;

at least one gate protruding from the runner; and means for releasably engaging the framework of the electroless plating rack; and a product substrate removably attached to each gate.

12. A product substrate assembly as claimed in claim 11 wherein the means for releasably engaging the framework of the electroless plating rack comprises at least one engaging member which releasably captures the framework of the electroless plating rack.

13. A product substrate assembly as claimed in claim 12 wherein the engaging member comprises a clip for releasably gripping the framework of the elecroless plating rack.

14. A product substrate assembly as claimed in claim 12 wherein the engaging member comprises a ring which can be mounted in surrounding relation to the framework of the electroless plating rack.

15. A product substrate assembly as claimed in claim 11 wherein the means for releasably engaging the framework of the electroless plating rack comprises at least one engaging member which is releasably captured by the framework of the electroless plating rack.

16. A product substrate assembly as claimed in claim 11 wherein the runner system further comprises a spacer for assuring a desired spacing between the product substrate assembly and an adjacent product substrate assembly when the product substrate assembly is mounted on the framework of the electroless plating rack.

17. A product substrate assembly as claimed in claim 16 wherein the spacer comprises means for releasably engaging the runner system of an adjacent product substrate assembly.

18. A product substrate assembly comprising:

a runner system comprising:

at least one runner;

at least one gate protruding from the runner; and means for releasably engaging the runner system of a second product substrate assembly; and a product substrate removably attached to each gate.

19. A product substrate assembly as claimed in claim 18 wherein the means for releasably engaging the runner system of a second product substrate assembly comprises at least one clip which releasably grips the runner system of the second product substrate assembly.

20. A method for producing an electrolessly plated plastic product substrate comprising:

injection molding a product substrate assembly comprising:

a runner system having at least one runner and means for releasably engaging the framework of an electroless plating rack; and at least one product substrate removably attached to the runner;

mounting the product substrate assembly on an electroless plating rack so that the product substrate does not contact the electroless plating rack; and electrolessly plating the product substrate assembly.

21. A process as claimed in claim 20 wherein the means for releasably engaging the framework of the electroless plating rack comprises at least one member which releasably captures the framework of the electroless plating rack.

22. A process as claimed in claim 20 wherein the means for releasably engaging the framework of an electroless plating rack comprises at least one member which is releasably captured by the framework of the electroless plating rack.

23. A process as claimed in claim 20 wherein the runner system of the product substrate assembly comprises at least one spacer for assuring the desired spacing between the product substrate assembly and an adjacent product substrate assembly when the product substrate assembly is mounted on the framework of the electroless frame rack.

24. A method for producing an electrolessly and electrolytically plated plastic product substrate comprising:

injection molding a product substrate assembly comprising:

a runner system having at least one runner and means for releasably engaging the framework of an electrolytic plating rack; and at least one product substrate removably attached to the runner;

mounting the product substrate assembly on an electroless plating rack;

electrolessly plating the product substrate assembly;

removing the electrolessly plated product substrate assembly from the electroless plating rack;

mounting the product substrate assembly on an electrolytic plating rack so that the product substrate does not contact the electrolytic plating rack; and electrolytically plating the product substrate assembly.

25. A process as claimed in claim 24 wherein the means for releasably engaging the framework of an electrolytic plating rack comprises at least one clip for releasably gripping the framework of the electrolytic plating rack.

26. A process as claimed in claim 24 wherein the runner system of the product substrate assembly comprises a spacer for assuring a desired spacing between the product substrate assembly, and an adjacent product substrate assembly when the product substrate assemble is mounted on the framework of the electrolytic plating rack.

27. A process as claimed in claim 24 wherein the runner system further comprises means for releasably engaging the framework of an electroless plating rack.

28. A process as claimed in claim 27 wherein the product substrate assembly is mounted on an electroless plating rack so that the product substrate does not contact the electroless plating rack.

* * * * *